US006932486B1

(12) United States Patent
Eller et al.

(10) Patent No.: US 6,932,486 B1
(45) Date of Patent: Aug. 23, 2005

(54) MORTISE LOCK WITH LIGHTED TRIM PLATE SIGN

(75) Inventors: Darren C. Eller, East Lyme, CT (US); Jay Krajewski, Coventry, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 10/785,563

(22) Filed: Feb. 23, 2004

(51) Int. Cl.[7] ..... F21V 9/16; E05B 17/10

(52) U.S. Cl. ..... 362/100; 362/84; 70/441; 70/454

(58) Field of Search ..... 362/84, 100; 70/432, 70/434, 441, 452, 453, 454, DIG. 59; 40/542, 40/544

(56) References Cited

U.S. PATENT DOCUMENTS

| | | | | |
|---|---|---|---|---|
| 2,503,044 | A * | 4/1950 | Guerra | 250/466.1 |
| 2,682,251 | A * | 6/1954 | Neugass | 116/328 |
| 3,126,218 | A * | 3/1964 | Andrews | 292/175 |
| 4,293,894 | A * | 10/1981 | Blank | 362/100 |
| 4,365,232 | A | 12/1982 | Miller | |
| 4,559,796 | A * | 12/1985 | De Forrest, Sr. | 70/432 |
| 4,801,928 | A | 1/1989 | Minter | |
| 5,499,170 | A | 3/1996 | Gagne | |
| 5,657,653 | A * | 8/1997 | Hensley et al. | 70/224 |
| 5,961,072 | A | 10/1999 | Bodle | |
| 6,058,635 | A | 5/2000 | Morris | |
| 6,174,004 | B1 | 1/2001 | Picard et al. | |
| 6,276,634 | B1 | 8/2001 | Bodle | |
| 6,447,139 | B1 * | 9/2002 | Wilkes | 362/100 |
| 6,461,012 | B1 * | 10/2002 | Shuman | 362/100 |
| 6,472,994 | B1 | 10/2002 | Tator | |
| 6,527,401 | B1 | 3/2003 | Chu | |
| 2001/0013185 | A1 | 8/2001 | Chien | |
| 2003/0189823 | A1 | 10/2003 | George et al. | |

* cited by examiner

*Primary Examiner*—Y. My Quach-Lee
*Assistant Examiner*—Peggy A. Neils
(74) *Attorney, Agent, or Firm*—DeLio & Peterson, LLC; Robert Curcio

(57) ABSTRACT

A standard mortise latch lock escutcheon or trim plate having an aperture for housing an electroluminescent strip captured within a two-piece lens structure. A dc or ac external power supply converter is used in conjunction with the existing grid power. The converter is situated on the mortise lock casing. The electroluminescent strip is captured within the lens structure along with partially transparent, lettered signage. The lens structure has an outer lens with a protrusion to align the signage within the aperture. The lettered signage is reversed lettered, such that light emits through the letters and is blocked by an opaque background when the electroluminescent strip is supplied power. In instances where the mortise latch lock is used on doors for purposes other than egress, a switch may be used to toggle power to the signage when the thumb lever is turned in a locked position.

14 Claims, 3 Drawing Sheets

MORTISE LOCK WITH LIGHTED TRIM PLATE SIGN

BACKGROUND OF THE INVENTION

1. Field of the Invention

This invention relates to exit devices using latch mechanisms mortised into a door, particularly mortise latch locks used with built-in lighted signage. More specifically, the invention relates to mortise latch locks with illuminated signage within the trim plate. The illuminated signage may be toggled ON or OFF to signal an occupied/unoccupied status, such as with a lavatory door.

2. Description of Related Art

Mortise latch locks are used in a variety of door locations and applications, often on several doors within a single room. Currently, there are no indications on the lock themselves for signaling which of the doors is the best means of egress from a room in an emergency. Moreover, mortise locks are becoming more commonly used on the doors that lead to a building's stairwells. Consequently, there exists a need to have mortise locks display signage, especially during emergency situations.

While mechanically actuated products exist to indicate the locked/unlocked status of the mortise lock, for example, the occupied/unoccupied status of a room, or designate an egress pathway, there are no electrically operated mortise locks that have illuminating signs and supporting electronics built within the lock or trim plate. Furthermore, the existing mechanical products are generally difficult to see from long distances or in low light situations. One problem regarding implementing an illuminated sign in a mortise lock trim plate is space. Typical trim plates are extremely thin, making it impractical to size any incandescent bulb(s) between the thin trim plate and the door face. A second issue is the availability of a sufficient power source for incandescent lights or other light sources, such as laser diodes and the like. Incandescent lights will normally drain batteries in a relatively short time, requiring either frequent replacement or a direct hard-wire to the power grid.

Due to the higher power requirements for incandescent lights as opposed to electroluminescent strips, heat dissipation has been a problem in the prior art when trying to integrate signage. The power required to illuminate light bulbs, and the light bulb illumination itself, will heat the trim plate until it becomes too hot to touch. Introducing electroluminescent strips into the trim plate design relieves the heat dissipation, since the electroluminescent strip requires less power to operate, and does not radiate as much heat energy as the incandescent lamps.

Bearing in mind the problems and deficiencies of the prior art, it is therefore an object of the present invention to provide a mortise latch lock with illuminating signage built into the lock trim plate.

It is another object of the present invention to provide illuminating signage for mortise locks that does not overheat the lock, and is efficient enough to work on battery power if required.

A further object of the invention is to provide a mortise latch lock with an illuminated sign capable of designating when the lock is activated and when it is deactivated.

Still other objects and advantages of the invention will in part be obvious and will in part be apparent from the specification.

SUMMARY OF THE INVENTION

The above and other objects, which will be apparent to those skilled in art, are achieved in the present invention, which is directed to a mortise trim plate having a front side and a backside, comprising: a lever handle mounted through the trim plate front side for extending and retracting a latch bolt within a mortise latch lock case; a thumb lever mounted through the trim plate front side for extending and retracting a dead bolt within the mortise latch lock case; an electroluminescent lighted sign having an overall thickness less than or equal to the depth of the trim plate; and an aperture through the trim plate for viewing the electroluminescent lighted sign. The electroluminescent lighted sign comprises: a lens structure; a lettering strip supported within the lens structure; and an electroluminescent strip supported within the lens structure; such that the lens structure secures the electroluminescent strip and the lettering strip to the aperture from the trim plate backside. The lens structure comprises an outer lens and an inner lens mechanically attached to one another with the electroluminescent strip and the lettering strip sandwiched therebetween. The outer lens includes at least one protruding shape to positively locate the outer lens within the aperture. The lettering strip comprises reverse printed clear spaces of alphanumeric characters and an opaque background such that the alphanumeric characters allow emitted light to pass through when power is applied to the electroluminescent strip.

In a second aspect, the present invention is directed to a mortise latch lock comprising: a case including a latch bolt and a dead bolt; a trim plate having a front side and a backside, the trim plate including: a lever handle mounted through the trim plate front side for extending and retracting the latch bolt within the case; a thumb lever mounted through the trim plate front side for extending and retracting the dead bolt within the case; an electroluminescent lighted sign having an overall thickness less than or equal to the depth of the trim plate; and an aperture through the trim plate for viewing the electroluminescent lighted sign; and an inverter circuit mounted to the case and providing electrical power to the electroluminescent lighted sign. The inverter circuit receives ±24 volts ac or ±24 volts dc power and converts the power to illuminate the electroluminescent lighted sign. A switch may be added to toggle the electroluminescent sign ON when the mortise latch lock is in a locked position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–3 of the drawings in which like numerals refer to like features of the invention.

The invention is directed to providing an illuminated sign to a mortise latch lock trim plate using electroluminescent technology. The illuminated sign typically identifies a point of egress. The lighted mortise latch lock is intended to augment EXIT signage that typically is placed above points of egress. Furthermore, the lighted trim plate may be used to indicate an occupied status, as for example on a lavatory door.

The present invention comprises a standard mortise latch lock escutcheon or trim plate with an aperture that houses an electroluminescent strip captured within a two-piece lens. A dc or ac external power supply at preferably 24 volts is used in conjunction with the existing grid power. A power inverter is added to the mortise assembly in order to transfer the 24 volts power supply to the correct specifications for illuminating the electroluminescent strip.

The electroluminescent strips are illuminators that include electroluminescent material preferably encased in a transparent or translucent electrically insulating material, such as the preferred two-piece lens system. The strips are typically powered with a 200 volt, 400 Hertz ac signal from an inverter. The inverter selected may be adaptable for any number of power sources. For example, inverter designs make it possible for the illuminators to activate when connected to a power source of 12 volts dc, 24 volts dc, or 110 to 120 volts ac. This allows the illuminators to run on power from an electrical grid, a portable generator, or under the necessary circumstances, a battery.

The illuminated mortise latch lock may be used in many places other than egress doors. One application, as previously mentioned above, is for a restroom, where an "OCCUPIED" or other similarly messaged lettered sign may be illuminated upon locking to display that the room is currently in use. In such an instance, it is desirable for the lettering to be visible only when power is supplied to the sign. In this situation, a shaded or reflective film may be added within the lens assembly between the lens and the lettering. The film provides for a solid uniform color when the sign indicator is OFF, while the lettering would show through when the sign indicator was ON or illuminated. For this application, the power inverter may be wired through a toggle switch, such as in a DX style mortise lock, which would provide power only when the deadbolt was in a locked position.

Since the light output of the electroluminescent strip will degrade over time, the lens assembly, which includes the electroluminescent strip, is designed to be readily replaceable. Similar to a light bulb, the replacement period will depend upon the amount of time that the electroluminescent strip is illuminated.

Figure 1:
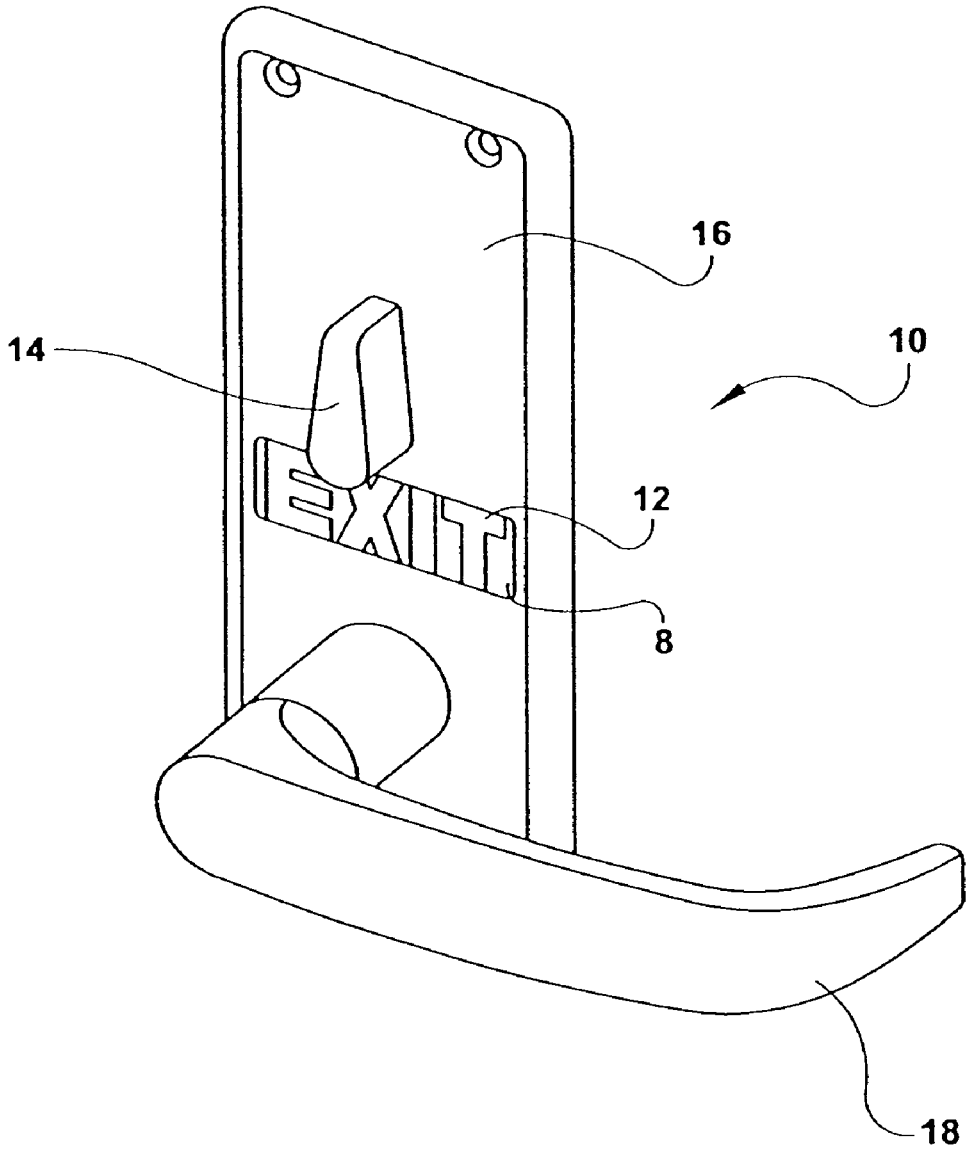
FIG. 1 depicts the front face of a mortise latch lock trim plate of the present invention with illuminated signage.

FIG. 1 depicts the front face of a mortise latch lock trim plate 10 with illuminated signage 12. In this example, the signage 12 represents an EXIT sign. The mortise lock trim plate includes a thumb lever 14, mounted through the trim plate front side 16, for extending and retracting a dead bolt (not shown) within a mortise latch lock case, and a lever handle 18, also mounted through the trim plate front side 16, for extending and retracting a latch bolt (not shown) within the mortise latch lock case. The signage 12 is mounted behind the trim plate 10, through an aperture 8 formed within the trim plate.

Figure 2:
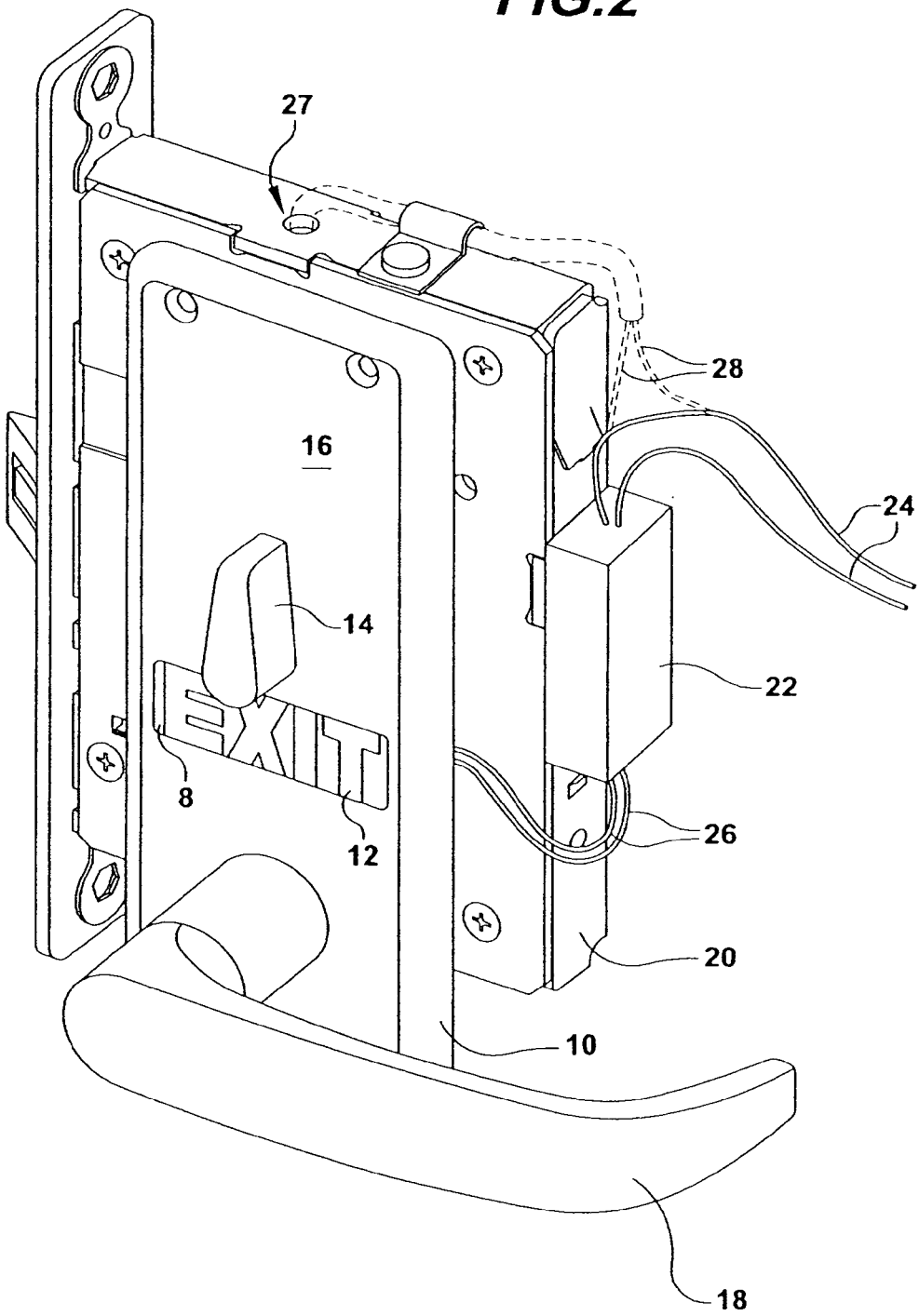
FIG. 2 depicts the mortise latch lock case with trim plate appropriately placed for proper attachment.

FIG. 2 depicts the mortise latch lock case 20 with trim plate 10 appropriately placed for proper attachment, but without an intervening door shown. Attached to the mortise latch lock case 20 is an inverter box 22, which is used to convert input power into power that is capable of illuminating the electroluminescent strip within the trim plate signage. Preferably, the input power to the inverter is ±24 volts ac or dc power; however, other input power requirements may be accommodated, such as 12 volts dc, or 110 to 120 volts ac. Conductor wires 24 receive input power from the outside grid. Conductors 26 connect the inverter 22 to the electroluminescent strip. The placement of the inverter box 22 on the outside of the case 20 allows the lock's mechanical features to remain intact and unfettered within the case, while transforming electrical power from the power grid to the electroluminescent lamp and the signage switch. In certain instances where the mortise latch lock is to be used with a door that requires an indicator during locking, such as an "OCCUPIED" sign for a bathroom door, wires 28 are used to connect the inverter to a signage switch within the case, accessible from the top 27 of the mortise latch lock case 20. The signage switch is designed to toggle power to the signage whenever the thumb lever 14 is turned to locked/unlocked position.

Figure 3A:
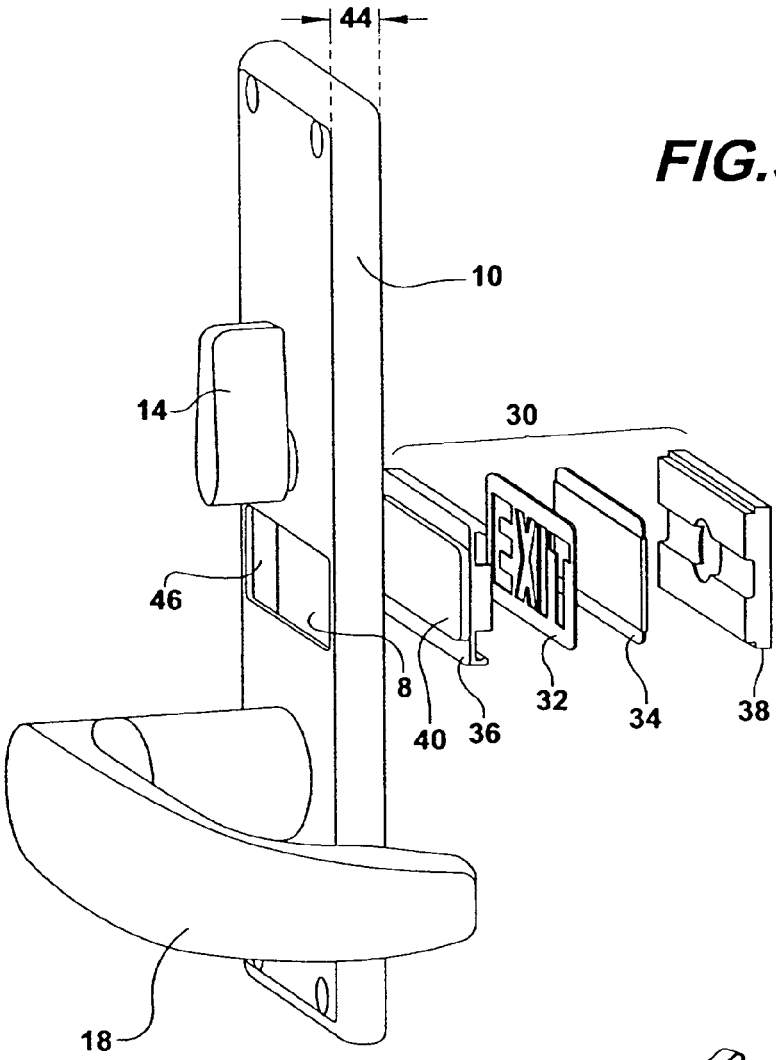
FIG. 3A is a front side angled view depicting the components of the electroluminescent signage.
Figure 3B:
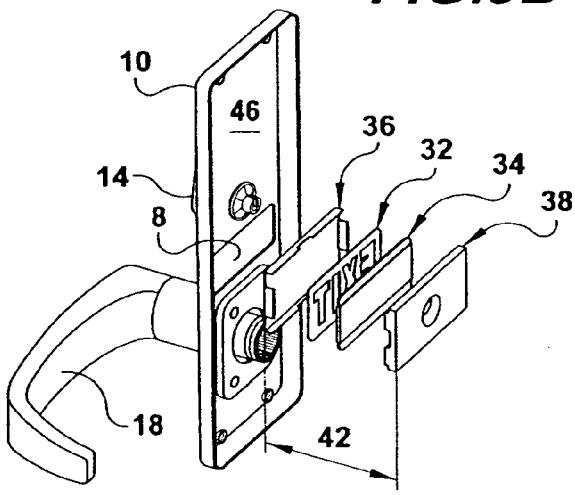
FIG. 3B is a backside angled view depicting the backside components of the electroluminescent signage.

FIG. 3A is a front side angled view depicting the components 30 of the electroluminescent signage. The sign lettering 32 and electroluminescent strip 34 are sandwiched between an outer lens portion 36 and an inner lens portion 38. The outer and inner lens structures are designed to mechanically attach, capturing the lettering and electroluminescent strip therebetween. The outer lens 36 includes at least one protruding shape 40 to positively locate it within the aperture 8 in the trim plate between the thumb lever 14 and the latch lever 18. In the preferred embodiment, the protruding shape 40 represents the outline of the aperture, and seats within the aperture. However, other protruding shapes may be considered provided the signage can be positively located within the aperture by the protruding shape. The total thickness 42 of the assembled components 30 is less than or equal to the thickness of the trim plate 44, such that when the trim plate is attached to a door, the door face surface facilitates in securing the signage components 30 to the trim face backside 46. Preferably, the thickness of the electroluminescent lamp is on the order of 0.020 inches. The lamp is sandwiched between the lens structures, which may comprise two clear pieces of polycarbonate plastic that mechanically snap together. The electroluminescent technology is extremely efficient, and the lamp produces very little heat in comparison to other lighting technologies. FIG. 3B is a backside angled view depicting the backside of the components 30 of the electroluminescent signage.

The lettering is accomplished with a clear plastic strip or a label that is placed between the illuminated electroluminescent strip and the outer lens. The lettering is preferably reverse printed so that the letters will remain clear, while the opaque background may be printed in any desired color. Thus, only the lettering allows the light to transmit through when the device is turned on. Using this lettering technique, the signage will be visible under normal lighting conditions, independent of whether the light strip is powered. The lettering strip may be attached to the outer lens by adhesive, friction, or mechanical fastener. The inner lens provides electrical insulation and mechanical support for the electroluminescent strip.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

What is claimed is:

1. A mortise trim plate having a front side and a backside, comprising:

a lever handle mounted through said trim plate front side for extending and retracting a latch bolt within a mortise latch lock case;

a thumb lever mounted through said trim plate front side for extending and retracting a dead bolt within said mortise latch lock case;

an electroluminescent lighted sign having an overall thickness less than or equal to the depth of said trim plate; and an aperture through said trim plate for viewing said electroluminescent lighted sign.

2. The mortise trim plate of claim 1 wherein said electroluminescent lighted sign comprises:

a lens structure;

a lettering strip supported within said lens structure; and an electroluminescent strip supported within said lens structure;

such that said lens structure secures said electroluminescent strip and said lettering strip to said aperture from said trim plate backside.

3. The mortise trim plate of claim 2 wherein said lens structure comprises an outer lens and an inner lens mechanically attached to one another with said electroluminescent strip and said lettering strip sandwiched therebetween.

4. The mortise trim plate of claim 3 wherein said outer lens includes at least one protruding shape to positively locate said outer lens within said aperture.

5. The mortise trim plate of claim 2 wherein said lens structure comprises a polycarbonate plastic material.

6. The mortise trim plate of claim 2 wherein said lettering strip comprises reverse printed clear spaces of alphanumeric characters and an opaque background such that said alphanumeric characters allow emitted light to pass through when power is applied to said electroluminescent strip.

7. The mortise trim plate of claim 3 further comprising a shaded or reflective film added within said lens structure between said outer lens and said lettering strip.

8. The mortise trim plate of claim 3 wherein said lettering strip is attached to said outer lens by adhesive, friction, or mechanical fastener.

9. The mortise trim plate of claim 3 wherein said inner lens provides electrical insulation and mechanical support for said electroluminescent strip.

10. A mortise latch lock comprising:

a case including a latch bolt and a dead bolt;

a trim plate having a front side and a backside, said trim plate including:

a lever handle mounted through said trim plate front side for extending and retracting said latch bolt within said case;

a thumb lever mounted through said trim plate front side for extending and retracting said dead bolt within said case;

an electroluminescent lighted sign having an overall thickness less than or equal to the depth of said trim plate; and an aperture through said trim plate for viewing said electroluminescent lighted sign; and an inverter circuit mounted to said case and providing electrical power to said electroluminescent lighted sign.

11. The mortise latch lock of claim 10 wherein said inverter circuit receives ±24 volts ac or ±24 volts dc power and converts said power to illuminate said electroluminescent lighted sign.

12. The mortise latch lock of claim 10 including a switch to toggle said electroluminescent sign ON when said mortise latch lock is in a locked position.

13. The mortise latch lock of claim 12 wherein said switch toggles said electroluminescent lighted sign ON when said dead bolt is in a locked position.

14. The mortise latch lock of claim 10 wherein said electroluminescent lighted sign comprises:

a lens structure;

a lettering strip supported within said lens structure; and an electroluminescent strip supported within said lens structure;

such that said lens structure secures said electroluminescent strip and said lettering strip to said aperture from said trim plate backside.

* * * * *